US005493749A

United States Patent [19]

Zayas

[11] Patent Number: 5,493,749

[45] Date of Patent: Feb. 27, 1996

[54] DEVICE FOR APPLYING AND REMOVING TOPICAL COMPOSITIONS

[76] Inventor: Margarita Zayas, 910 N. Francisco Ave., Chicago, Ill. 60622

[21] Appl. No.: 155,795

[22] Filed: Nov. 23, 1993

[51] Int. Cl.[6] ..... A47K 7/02

[52] U.S. Cl. ..... 15/244.2; 15/184; 15/244.1; 132/320; 206/361

[58] Field of Search ..... 15/104.94, 184, 15/244.1–244.3; 132/320; 401/207; 601/17, 137, 138, 154; 604/1; 206/361, 362.2, 362.3

[56] References Cited

U.S. PATENT DOCUMENTS

| | | | |
|---|---|---|---|
| 693,305 | 2/1902 | Parvin | 15/184 |
| 919,440 | 4/1909 | Lawson et al. | 15/184 |
| 1,270,536 | 6/1918 | Maher | 15/244.1 |
| 2,631,317 | 3/1953 | De Kolb | 15/244.1 |
| 2,651,070 | 9/1953 | Zimmerman | 15/184 |
| 2,844,837 | 7/1958 | Mackert | 15/244.2 |
| 2,922,180 | 1/1960 | Render | 15/244.1 |
| 3,345,669 | 10/1967 | Starry | 15/244.1 |
| 3,590,414 | 7/1971 | Gores | 15/244.1 |
| 3,775,017 | 11/1973 | Jerry | 15/244.1 |
| 4,299,005 | 11/1981 | Brown | 15/244.2 |
| 4,414,700 | 11/1983 | Burns | 15/244.3 |
| 4,455,705 | 6/1984 | Graham | 15/244.2 |
| 4,642,835 | 2/1987 | Schmitz | 15/184 |
| 5,003,659 | 4/1991 | Paepke | 15/244.1 |
| 5,058,233 | 10/1991 | Davis, III | 15/244.1 |

FOREIGN PATENT DOCUMENTS

| | | | |
|---|---|---|---|
| 488108 | 11/1952 | Canada | 15/244.1 |
| 1037671 | 8/1958 | Germany | 15/244.1 |
| 371069 | 5/1939 | Italy | 15/244.1 |
| 176157 | 6/1935 | Switzerland | 15/244.1 |
| 811195 | 4/1959 | United Kingdom | 15/184 |
| 1181230 | 2/1970 | United Kingdom | 15/244.1 |
| 2160092 | 12/1985 | United Kingdom | 401/207 |

*Primary Examiner*—Mark Spisich
*Attorney, Agent, or Firm*—Foley & Lardner

[57] ABSTRACT

A device for applying and removing topical compositions to or from the skin of either a man or woman which comprises a handle, a handle base, a sponge, and a cap.

18 Claims, 2 Drawing Sheets

DEVICE FOR APPLYING AND REMOVING TOPICAL COMPOSITIONS

BACKGROUND OF THE INVENTION

1. Field of the Invention

The present invention is directed to a device for applying and removing makeup, foundation, powders, rouge, lotions, beauty aids or other cosmetics as well as medicinals or the like (hereinafter all referred to as "topical compositions") to the skin.

2. Description of the Prior Art

Applying and removing topical compositions, such as cosmetics, represents a daily routine which is often viewed as unpleasant due to the awkward and messy nature of manual application. Manually applying topical compositions places the hand in direct contact with the skin which hampers one's ability to target the composition to the desired area and promotes the spread of germs from the hand to the face and vice versa.

Many types of applicators have been tried in the prior art. However, these devices have various limitations that restrict their use and are generally unsuitable for both removing and applying compositions to the skin (i.e. the face) in an advantageous manner. Moreover, the prior art applicators are complicated to operate and are expensive to maintain. As examples of some of the known applicators one may refer to the following U.S. patents.

There is disclosed in U.S. Pat. No. 3,590,414 an oral applicator which has a sponge block mounted to a handle using a combination of hooks and VELCRO. The handle may be connected to the head portion by an offsetting or angled portion. This applicator is apparently not designed for the application of topical compositions.

U.S. Des. Pat. No. 310,270 discloses a suntan lotion applicator having an elongated handle with a circular applicator pad mounted at an angle at one end of the handle. A threaded cap is fastenable over the pad at the end of the handle.

U.S. Des. Pat. No. 299,558 discloses a combined body lotion applicator and cover with an enlarged head with a curved handle. A cover is shown on the enlarged head.

SUMMARY OF THE INVENTION

The present device through the design of its constituent parts; a handle, a base, a sponge, and a cap, provide convenient features for the fast-paced lifestyles of both men and women. This device serves to make the daily routine of applying and removing topical compositions (which include cosmetics and medicinals) more pleasurable since the present product enables both the application and removal of topicals to be neat, accurate, and sanitary. The present device promotes efficient application and removal of the topical composition to or from any skin surface, especially the face. The ease of applying and removing topicals with the present device is necessarily enhanced due to the increased visibility of the face due to removal of the hands away from the field of vision when viewing the face in a mirror.

The present invention provides for the sanitary application and removal of topical compositions by avoiding contact of the hands with both the skin and the sponge. Furthermore, any topical remaining on the sponge is prevented from being spread when the sponge is in, for example, a purse or cosmetic bag. The ability to dispose of soiled sponges and fasten new sponges for use serves to promote the hygienic nature of the present invention. In addition, the cap prevents bacteria from reaching the sponge and thereby being transferred to the skin.

BRIEF DESCRIPTION OF THE FIGURES

With the above and related objects in view, the invention comprises the details of construction and combination of parts, as will be more fully understood from the following description, when read in conjunction with the accompanying drawings and numbered parts, in which.

DETAILED DESCRIPTION OF THE PREFERRED EMBODIMENTS

Figure 1:
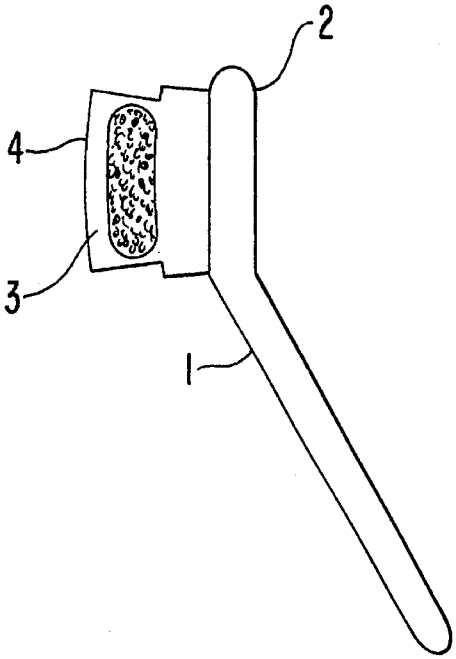
FIG. 1 is a side view of the present invention showing the sponge 3 and the overlying cap 4 mounted on the base 2 of the handle 1.

The present invention is directed to a device for both applying and removing topical compositions such as makeup, foundation, powders, rouge, lotions, beauty aids or other cosmetics as well as medicinals, pharmaceuticals or the like. The present device is suitable for applying or removing topical compositions from or to any skin surface, especially the face. This device is composed of four parts; a handle, a base, a sponge, and a cap. The base, sponge and cap can be made in various shapes and sizes. The handle can be universal in its use with all shapes. Each individual part has a specific function and all parts function together to create the tool of choice.

1. THE HANDLE

The handle is a feature which allows for the precise application of a topical composition to the skin surface. Since the person's hand is on the handle and away from their skin, the person is able to view the application or removal process unimpeded. A grip may be provided on the lower half of the handle furthest from the base to facilitate the grasping and handling of the device. The handle promotes personal hygiene since the hands and the skin surface do not make contact, lessening the spread of bacteria.

2. THE BASE OF THE HANDLE

The base of the handle is continuous with the handle on the side of attachment to the sponge in a single plane at an angle which may vary from 0 to 180 degrees with a range between 30 to 60 degrees being preferred and approximately fifty degrees being the most preferred. In an alternative embodiment, the base and the handle can be attached by way of a hinge which permits free rotation along the plane of the base and handle. This feature would permit the adjustment of the angle between the base and handle which could vary from 0 to 180 degrees dependant upon the contour of the skin surface to which the device is applied.

The front side of the base has three grooves for the placement of the cap. A fastener, such as a snap, clip or VELCRO (hook and loop material) strip is present on the center of the base to permit attachment of the base to the sponge.

3. THE SPONGE

The sponge is made of a flexible and preferably absorbent material and may vary in shape. A preferred embodiment includes a dense cosmetic grade latex that is flat and shaped like a square with a rounded upper corner. This preferred shape allows for smooth application to even the smallest areas of the skin. Like using a paint brush to paint a picture, this unique device allows the applicant to work on small areas uniformly. The sponge's size and shape also make it an excellent tool for highlighting and contouring as well as use as a cleansing pad for the removal of topicals.

The sponge has a fastener on one of its sides, such as a clip, snap or VELCRO (hook and loop material) strip, to permit attachment to the fastener that is present on the center of the base of the handle. After the sponge has been used, it can easily be removed from the handle base and replaced with a clean sponge. The soiled sponge can later be washed and reused on the same handle. The disposable nature of the sponge represents a convenient feature.

4. THE CAP

The cap is designed to be convenient and sanitary. The cap protects the sponge from bacteria which might be on any surface that the sponge makes contact with between periods of use. The openings on its top surface allows for ventilation which reduces bacterial growth. These openings can be of any shape which provides adequate ventilation. But it is preferable that the opening is composed of a grid or a multiplicity of pores. The design of the cap enhances the current device's ability to function as a convenient traveling tool. The cap serves to protect the sponge and surrounding surfaces from cross contamination.

The composition of the handle, base and cap are not restricted to any one particular material, but a composition should be selected which is nonallergenic and not excessively heavy in weight. The handle, base and cap can be made of different materials but it is preferable that the materials for all three be uniform. It is further preferable that the material selected be light in weight which permits increased comfort and maneuverability with use of the device. Suitable materials include plastics or other polymer compositions such as polycarbonate or polystyrene.

Figure 2:
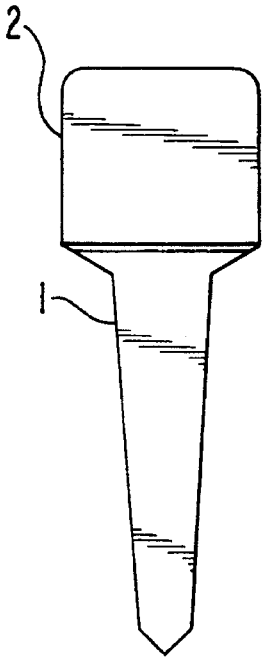
FIG. 2 is a back view showing the handle 1 and its base 2.
Figure 3:
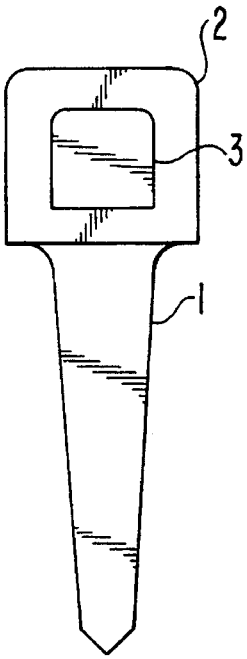
FIG. 3 is a front view of the handle 1 and its base 2 with sponge 3 attached thereto.
Figure 4:
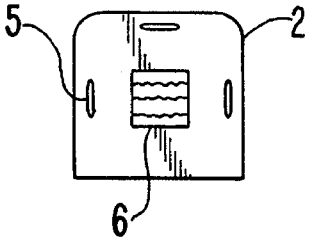
FIG. 4 is a front view of the base 2 showing three slots 5 for the attachment of the cap 4 and a rectangular or square piece of VELCRO 6 fastened to the base 2 to permit the attachment of the sponge 3.
Figure 5:
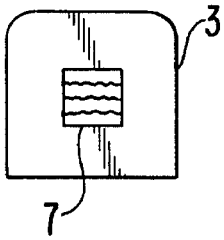
FIG. 5 is a back view of the sponge 3 with attached VELCRO 7.
Figure 6:
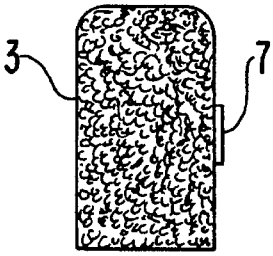
FIG. 6 is a side view of the sponge 3 with attached VELCRO 7.
Figure 7:
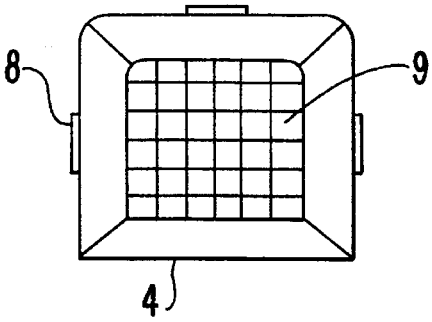
FIG. 7 is a top view of the cap 4 with three tabs 8 and a grid 9 in the center of the cap 4.

FIGS. 1–7 described a preferred embodiment of the present invention. The drawing in FIG. 1 shows a device having a sponge 3 attached to a base 2 which has a handle 1 extending therefrom formed in one piece with the base. A cap 4 fits over the sponge and attaches to the base 2. FIG. 2 shows the backside contour of the base 2 and its handle 1 which are continuous and permit the ease and comfort of grasping the handle at a point away from the base. The handle 1 and base 2 are attached to one another at approximately a 50 degree angle with the base 2 serving as a platform onto which the sponge 3 is mounted. The handle 1 tapers away from the base as shown in FIG. 3. The length of the handle is approximately 3.5 inches long with a tapering width which is approximately ¾ of an inch at its widest point and ½ inch at its narrowest point. The base of the handle is approximately 1.5 inches in both length and width with a thickness of ⅛ inch. The two upper corners of the handle's base are preferably rounded. One surface of the base 2 to be contacted by the sponge possesses a VELCRO (hook and loop material) strip 6, which is approximately centered on the base and approximately ½ inch square, while the other portion of the VELCRO (hook and loop material) strip 7 is attached to the back of the sponge 3 so that the sponge 3 is removable and therefore replaceable on the base as illustrated in FIGS. 4–6. The sponge 3 is approximately one inch square and ½ inch thick. The VELCRO (hook and loop material) 7 attached to the back of the sponge 3 is approximately ½ inch square. Several different sponges may be provided so that different types of topical compositions can be applied or removed using the same applicator. The base 2 of the handle 1 also include grooves, preferably on three sides, which engage the tabs 8 extending from the three sides of the cap 4 as illustrated in FIGS. 4 and 7. The top surface of the cap 4 is formed as an open grid 9 to provide ventilation to the sponge 3 as illustrated in FIG. 7. The cap has three tabs; one on each of it's sides and one on it's curved top for engaging the grooves 5 present on the base 2. The tabs snap into the grooves that are located on the base. The inside of the cap 4 is hollow to accommodate the sponge. The sides of the cap are solid and the width of the sides extend slightly beyond the width of the sides of the sponge.

Figure 8:
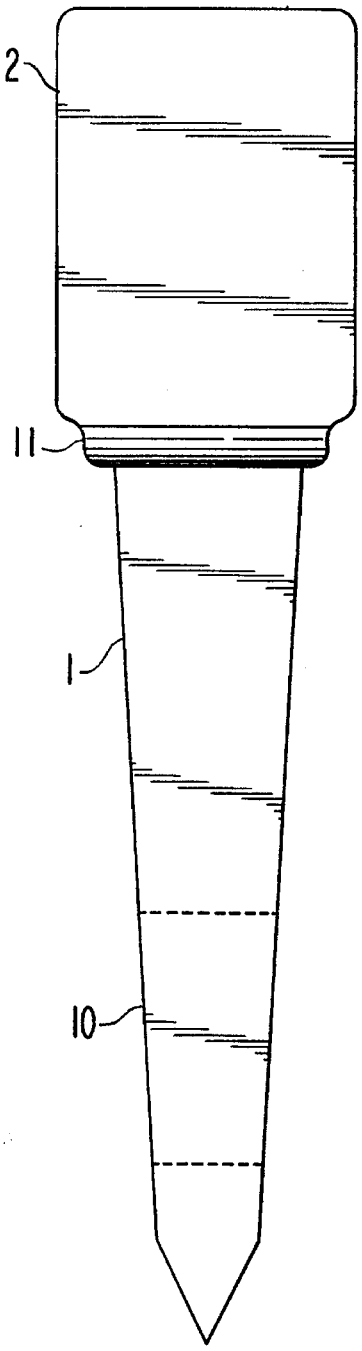
FIG. 8 is a back view showing the handle 1, its base 2, the adjustable hinge 11 between the handle 1 and base 2, and the grip 10 on the lower half of the handle 1.
Figure 9:
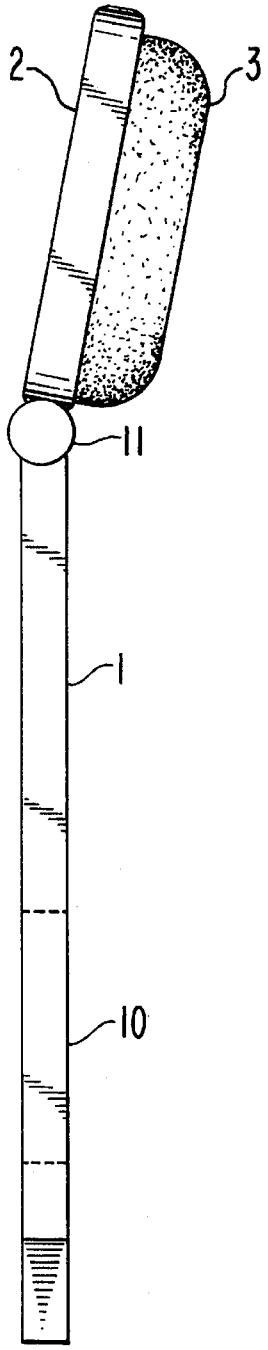
FIG. 9 is a side view showing the handle 1, its base 2, the sponge 3, the adjustable hinge 11 between the handle 1 and base 2, and the grip 10 on the lower half of the handle 1.
Figure 10:
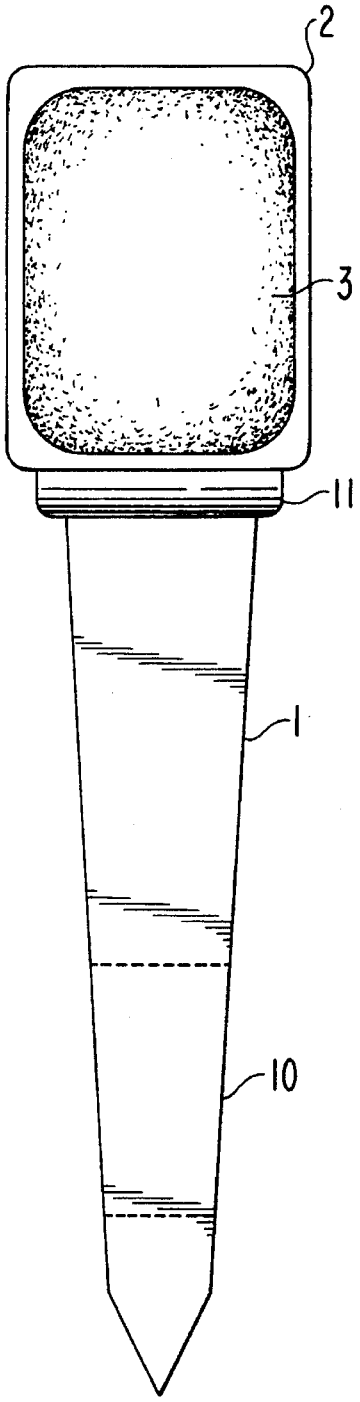
FIG. 10 is a front view showing the handle 1, its base 2, the sponge 3, the adjustable hinge 11 between the handle 1 and base 2, and the grip 10 on the lower half of the handle 1.

FIG. 8 shows a preferred embodiment from the back having the handle 1, its base 2, the adjustable hinge 11 between the handle 1 and base 2, and a grip 10 on the lower half of the handle 1. FIG. 9 shows the preferred embodiment from the side having the handle 1, its base 2, the sponge 3, an adjustable hinge 11 between the handle 1 and base 2, and the grip 10 on the lower half of the handle 1. Finally, FIG. 10 shows the preferred embodiment from the front having the handle 1, its base 2, the sponge 3, the adjustable hinge 11 between the handle 1 and base 2, and the grip 10 on the lower half of the handle 1.

While the invention has been described in detail and with reference to specific embodiments thereof, it will be apparent to one skilled in the art that various changes and modifications can be made therein without departing from the spirit and scope of the invention.

What is claimed is:

1. A device for applying or removing topical compositions which comprises: an elongated handle having a lower segment adapted for manual grasping and an upper segment which extends continuously into a square base; said square base having first and second opposite faces and comprising a first fastener attached to the first face of the square base and three grooves adapted to permit attachment of a cover which are formed adjacent to three sides of the first face of the square base; and a square sponge comprising a second fastener attached to a center of a surface of the sponge which removably attaches to the first fastener at a center of the base.

2. A device for applying or removing topical compositions as in claim 1 which further comprises a cap having three tabs adapted for insertion into the three grooves present in the square base wherein the cap when inserted completely covers the sponge attached to the square base.

3. A device for applying or removing topical compositions as in claim 2 in which the cap contains pores to allow ventilation of the underlying sponge.

4. A device for applying or removing topical compositions as in claim 2 in which a top center of the cap contains grid openings permitting ventilation to the underlying sponge.

5. A device for applying or removing topical compositions as in claim 2 in which the base, handle and cap are all made of plastic.

6. A device for applying or removing topical compositions as in claim 2 in which the cap is approximately the same size as the base.

7. A device for applying or removing topical compositions as in claim 1 wherein the handle tapers away from the base.

8. A device for applying or removing topical compositions as in claim 1 in which the the base and handle cooperate to define an angle which is approximately fifty degrees.

9. A device for applying or removing topical compositions as in claim 1 in which the first and second fastener is hook and loop material.

10. A device for applying or removing topical compositions as in claim 9 in which the hook and loop material present on the base and the sponge is approximately ½ inch square with an approximate thickness of ½ inch.

11. A device for applying or removing topical compositions as in claim 1 in which the sponge is made of dense cosmetic grade latex.

12. A device for applying or removing topical compositions as in claim 1 in which the base and the handle are both made of plastic.

13. A device for applying or removing topical compositions as in claim 1 in which the length of the handle is approximately 3.5 inches long and wherein the handle is tapered so that the handle is approximately ¾ of an inch at its widest point and approximately ½ inch at its narrowest point.

14. A device for applying or removing topical compositions as in claim 1 in which the base is approximately 1.5 inches in both length and width with a thickness of approximately ⅛ inch.

15. A device for applying or removing topical compositions as in claim 1 in which two corners of the square base are rounded.

16. A device for applying or removing topical compositions as in claim 1 wherein a grip is provided on a lower half of the handle furthest from the base.

17. A device for applying or removing topical compositions which comprises: a handle having a lower segment adapted for manual grasping and an upper segment which extends continuously into a square base wherein the base and handle cooperate to define an angle which is approximately thirty to sixty degrees; said square base having first and second opposite faces and comprising a first fastener attached to the first face of the square base and three grooves adapted to permit attachment of a cover which are formed adjacent to three sides of the first face of the square base; and a square sponge comprising a second fastener attached to a center of a surface of the sponge which removably attaches to the first fastener at a center of the base.

18. A device for applying or removing topical compositions which comprises: a handle having a lower segment adapted for manual grasping and an upper segment which is a square base, wherein the upper and lower segments of the handle are connected by an adjustable hinge; said square base having first and second opposite faces and further comprising a first fastener attached to the first face of the square base and three grooves adapted to permit attachment of a cover which are formed adjacent to three sides of the first face of the square base; and a square sponge comprising a second fastener attached to a center of a surface of the sponge which removably attaches to the first fastener at a center of the base.

* * * * *